US006729159B2

(12) United States Patent
Rose

(10) Patent No.: US 6,729,159 B2
(45) Date of Patent: May 4, 2004

(54) INTERCHANGEABLE JEWELRY SYSTEM

(76) Inventor: Laura Jeanene Rose, 5377 Romford Dr., San Jose, CA (US) 95124

( * ) Notice: Subject to any disclaimer, the term of this patent is extended or adjusted under 35 U.S.C. 154(b) by 0 days.

(21) Appl. No.: 10/197,282

(22) Filed: Jul. 16, 2002

(65) Prior Publication Data

US 2004/0011079 A1 Jan. 22, 2004

(51) Int. Cl.[7] ..... A44C 17/02

(52) U.S. Cl. ..... 63/29.1; 63/3.1; 24/574.1; 24/702; 24/669; 24/DIG. 52

(58) Field of Search ..... 63/29.1, 3.1; 24/DIG. 52, 24/702, 669, 574.1

(56) References Cited

U.S. PATENT DOCUMENTS

| | | | | | |
|---|---|---|---|---|---|
| 400,511 | A | * | 4/1889 | Tainter | 24/644 |
| 409,744 | A | * | 8/1889 | Garben | 446/104 |
| 2,219,277 | A | * | 10/1940 | Kaufmann | 63/21 |
| 2,316,225 | A | * | 4/1943 | Hoffman et al. | 63/29.1 |
| 2,586,758 | A | * | 2/1952 | Zerr | 24/518 |
| 3,900,927 | A | * | 8/1975 | D'Angelo et al. | 24/667 |
| 4,265,098 | A | * | 5/1981 | Wayne | 63/1.16 |
| 4,305,262 | A | | 12/1981 | Ferrara | |
| 4,393,667 | A | * | 7/1983 | Reinstein et al. | 63/29.1 |
| 4,400,932 | A | | 8/1983 | Epstein | |
| 4,426,854 | A | * | 1/1984 | Geldwerth et al. | 63/4 |
| 4,430,869 | A | * | 2/1984 | Zinni | 63/23 |
| 4,539,736 | A | * | 9/1985 | Yokosuka | 24/644 |
| 4,551,993 | A | * | 11/1985 | Nagahori | 63/31 |
| 4,554,800 | A | * | 11/1985 | Moon | 63/23 |
| 4,581,904 | A | * | 4/1986 | Lehmann et al. | 63/23 |
| 4,899,556 | A | | 2/1990 | Ford | |
| 5,008,984 | A | * | 4/1991 | Levy | 24/303 |
| 5,048,311 | A | | 9/1991 | Mastrobuono | |
| 5,228,317 | A | | 7/1993 | Hendricks | |
| 5,231,740 | A | * | 8/1993 | Mohebkhosravi | 24/616 |
| 5,339,655 | A | * | 8/1994 | Grando | 63/9 |
| 5,355,698 | A | | 10/1994 | Edmark | |
| 5,357,770 | A | | 10/1994 | Lanyi | |
| 5,375,434 | A | | 12/1994 | Wertheimer et al. | |
| 5,410,784 | A | * | 5/1995 | Katz | 24/587.1 |
| 5,456,095 | A | | 10/1995 | Tawil et al. | |
| 5,491,986 | A | | 2/1996 | White | |
| 5,505,061 | A | | 4/1996 | Fleury, Jr. et al. | |
| 5,606,874 | A | | 3/1997 | Archetti et al. | |
| 5,678,282 | A | * | 10/1997 | Stewart | 24/68 J |
| 5,722,260 | A | * | 3/1998 | Mangano | 63/3.1 |
| 5,727,399 | A | | 3/1998 | Bergagnini | |
| 5,758,516 | A | * | 6/1998 | Uematsu | 63/23 |
| 5,774,957 | A | * | 7/1998 | Kohl et al. | 24/701 |
| 5,927,104 | A | | 7/1999 | Green | |
| 6,058,737 | A | | 5/2000 | Domagala | |
| 6,131,408 | A | | 10/2000 | Gill | |
| 6,209,351 | B1 | | 4/2001 | Zeleny | |
| 6,212,869 | B1 | * | 4/2001 | Sadowsky | 59/80 |
| 6,318,122 | B1 | | 11/2001 | Burgard | |
| 6,381,985 | B1 | | 5/2002 | Burgard | |
| 6,470,708 | B1 | * | 10/2002 | Green | 63/3.2 |
| 2001/0045105 | A1 | * | 11/2001 | Takessian | 63/29.1 |

FOREIGN PATENT DOCUMENTS

GB 2272938 A * 6/1994 ..... A44C/5/18

OTHER PUBLICATIONS

Italian Charm Bracelets. For example, as shown at: http://giftsandgiggles.com/itcharbrac2.html, Aug. 2, 2002.

Seidengang Designs Flip–Ring. See: http://www.seidengangdesigns.com, and go to the product catalog for rings in the classic collection, Aug. 2, 2002.

Convertible Necklaces, such as: http://pages.tias.com/748/592848.html., Aug. 2, 2002.

* cited by examiner

*Primary Examiner*—J. J. Swann
*Assistant Examiner*—Thomas Ho

(57) ABSTRACT

Interchangeable Jewelry System for creating custom jewelry assemblies (20, 20', and 20"). Custom assemblies of one or more interchangeable jewelry segments (22). Interchangeable jewelry segments can contain male (38) and/or female (44) interchangeable mechanisms and/or body connector assemblies (60, 60', and/or 60") for attaching to the body or to items which attach to the body.

11 Claims, 5 Drawing Sheets

INTERCHANGEABLE JEWELRY SYSTEM

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION—FIELD OF INVENTION

This invention relates to the jewelry industry, specifically jewelry that employs the use of interchangeable jewelry segments and the mechanisms which allow those segments to be interchanged.

BACKGROUND—DISCUSSION OF PRIOR ART

The adornment of various parts of the body with jewelry is a concept that predates recorded history. In modern times, most jewelry designs include some sort of gemstone set in a mounting, and possibly associated with some sort of aesthetic design element (e.g. engraving, finish, etc.). The mounting, the gemstone, the aesthetic design, and the functional components (e.g. additional material to attach item to the body, etc.) are typically fashioned in such a way that they form a single static unit. That is, the gemstone is permanently set in the mounting, and the mounting is permanently attached to the rest of the piece (e.g. attached to a necklace chain or an earring post). This provides the jewelry wearer with one look for every item purchased. Thus, there is a need for a jewelry system which will allow for a more economic and personalized jewelry experience where one purchase can provide many looks.

Various enhancements to this static jewelry style have been proposed in the prior art. Many of the designs in the prior art focus on the exchange of the gemstone itself, and therefore modify the mechanical design of the mounting by adding some grasping mechanism to hold and release the gemstone. Generally speaking, this means that the jewelry user is manipulating loose gemstones, many of which are small and/or not colored (e.g. diamonds) and are therefore difficult to see and hold. Thus, this kind of design increases the likelihood that an expensive gemstone can be lost. Other prior art does focus on the interchangeability of larger sections of the jewelry piece, such as the mounting and the stone together in one unit. However, it is difficult to devise a mechanism which provides the interchangeability without affecting the aesthetic nature of the jewelry. Since jewelry is a fashion item, the look of the piece is very important, and any additional lines, creases, cracks, gaps, hinges, or clasping mechanisms, etc., which are visually present and/or obtrusive to the observer will detract significantly from the desirability, and thus the marketability, of the design.

Other designs, such as U.S. Pat. No. 6,131,408, Gill (2000), attempt to change the look by adding moveable or changeable accessories. These designs, however, do not change the true nature of the jewelry, but rather seek only to adorn a static unit further. U.S. Pat. No. 5,927,104 (1999), Green, and U.S. Pat. No. 6,058,737 (2000), Domagala, both illustrate designs which create a more dynamic earring.

Green's design employs a cylindrical earring in which attachments are added via a threaded screw mechanism. While unique, this design is very limited to static types of jewelry (i.e. where the jewelry attachments can't move with some independence from the base). Additionally, relying on screws to maintain the attachment leaves one vulnerable to either the screw becoming loose through movement and vibration, or requiring so much torque to tighten that the design is compromised. Domagala presents a design which is limited to vertical-type attachments via a sliding projection design. This limits the total number of attachments, creates a static design, and does not provide much mechanical stability.

Previous attempts have been made to create designs that provide more flexibility to the jewelry buyer. U.S. Pat. No. 6,209,351, Zeleny (2001), is an example of a design which resorts to clip mechanisms to hold both the center stone in its mount and an ornamental attachment to the side. The center stone can be taken out of the clips that hold it, which creates a dangerously unstable mounting, in which the center stone may inadvertently fall out. Prior art that focuses solely on the interchangeability of the center stone is much more reliable in this respect, but lacks the interchangeability of other jewelry sections and exhibits the detractions described above. The ornamental attachment in Zeleny is held by a curved arm mechanism which slips over the metal cage holding the gemstone. While perhaps unique in mechanical design, this does not provide for much stability or rigidity in a piece which could easily fall out.

The lack of a successful design for interchangeable jewelry which is both functional and aesthetically pleasing is made clear by research into the commercial jewelry market. To the applicant's knowledge, there are virtually no jewelry designs of this type being actively marketed and sold. This is because the jewelry user will not buy a piece that sacrifices look for function.

Lacking in all of the prior art is a jewelry concept that allows the jewelry user to mix and match segments of jewelry into any number of custom assemblies that conceal the attachment mechanisms sufficiently to maintain aesthetic appeal. Prior art focuses on the exchange of gemstones within a mounting, or on the addition of an extra ornament. Thus the need still exists for a system of interchangeable jewelry which the jewelry wearer will find flexible in final assembly, while retaining the visual appeal that is so important in this fashion conscious industry. This invention addresses those needs.

BACKGROUND—OBJECTS AND ADVANTAGES

Accordingly, several objects and advantages of the present Patent Application of Laura J. Rose for "Interchangeable Jewelry System" are:

(a) to provide a system of jewelry with interchangeable segments which provides the most flexibility for creating personalized custom jewelry assemblies (i.e. maximizes number of possible combinations);

(b) to provide an interchangeable mechanism which allows for jewelry segments to be interchanged across jewelry styles (e.g. earring, bracelet, pendant, etc.);

(c) to provide a system of interchangeability which minimizes the aesthetic impact of the interchangeable mechanism (i.e. hidden from ordinary view);

(d) to provide an interchangeable system which is easy for an average person to use;

(e) to provide a jewelry system which is highly flexible in the types of final combinations that can be created;

(f) to provide an interchangeable mechanism which exhibits mechanical integrity and minimizes the stress on weight-bearing components of the design;

(g) to provide an interchangeable mechanism which is both durable and yet easy to replace should it somehow be broken;

(h) to provide all of the above advantages with an interchangeable mechanism that is easy to manufacture, so that cost savings can be passed to the consumer.

Further objects and advantages include:

1) the ability to interchange stone colors without resorting to complex and difficult to use gemstone grasping mechanisms;

2) the ability of the jewelry user to wear a piece created through this interchangeability design without the negative visual impact created by obtrusive hinges, clasps, creases, etc.;

3) the ability to create jewelry pieces unlimited in the total number of possible segments;

4) an interchangeable design which does not rely on a user's guess as to the tightness of the contact (e.g. screw/thread mechanism)—a successful closure can be felt/heard.

A significant object and advantage that should be elaborated upon is the unobtrusive nature of the interchangeable design, and particularly the substantial concealment of the connecting mechanisms. Most jewelry which contains gemstones leaves the back of the stone uncovered. That is, the gemstone is mounted with prongs holding it from the sides, or with a bezel, in which metal is surrounding the girdle of the gemstone. In both cases, and in most other mountings, the "backside", or pavilion, of the gemstone is left exposed. This is due to the nature of the light/gemstone interaction which creates visual appeal. If an object were to intrude into or cover portions in the area behind the gemstone, it would lessen the visual appeal of the gemstone, and thus the marketing appeal of the interchangeable design. Still further objects and advantages will become apparent from a consideration of the ensuing description and drawings

SUMMARY

The interchangeable nature of the jewelry detailed in this Patent Application of Laura J. Rose for "Interchangeable Jewelry System" allows the jewelry wearer to create, from a set of interchangeable jewelry segments, a unique custom jewelry assembly which can be coordinated to the user's desires (general taste, outfit being worn, color coordination, event attended, etc.). The segmenting of the jewelry sections and the design of the interchangeable mechanism affords the user this flexibility while providing ease of use in a durable and affordable manner. In accordance with the present invention, the following definitions are made:

(1) Custom Jewelry Assembly—User-assembled custom design consisting of one or more interchangeable jewelry segments, at least one of which is an interchangeable jewelry base.

(2) Interchangeable Jewelry Segment—The segment of jewelry that contains the interchangeable mechanism(s), and optional gemstone(s) and/or aesthetic design component (s). One or more interchangeable jewelry segments may be daisy-chained together.

(3) Interchangeable Jewelry Base—The interchangeable jewelry segment that connects either directly to the human body (e.g. an earring post to go through an earlobe, etc.), or indirectly to a piece that further connects to the human body (e.g. a connection to a necklace chain to go around the neck, etc.) An interchangeable jewelry base is a specific kind (subset) of interchangeable jewelry segment.

(4) Interchangeable Mechanism—The mechanism in accordance with the present invention which consists of:

(a) A female mechanism—The preferred embodiment of said female mechanism is comprised of a latch assembly attached to a hinge and a button which the latch assembly can close onto; when closed, the latch assembly covers a slot into which the male mechanism fits.

(b) A male mechanism—the preferred embodiment of said male mechanism is comprised of a projection with attached projection obstacle which fit and interlock into the female mechanism.

The male mechanism from one interchangeable jewelry segment connects into the female mechanism in another interchangeable jewelry segment, thus interlocking the two jewelry segments.

DRAWINGS—FIGURES

In the drawings, closely related figures have the same number, but different alphabetic suffixes.

Figure 3A:
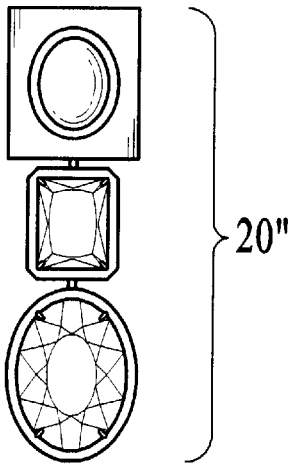
Figure 3B:
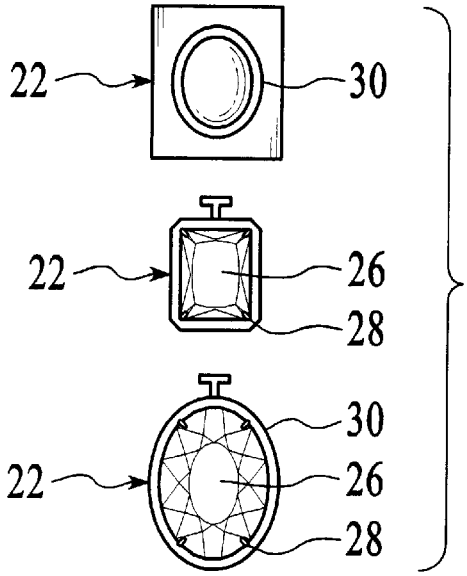
Figure 3C:
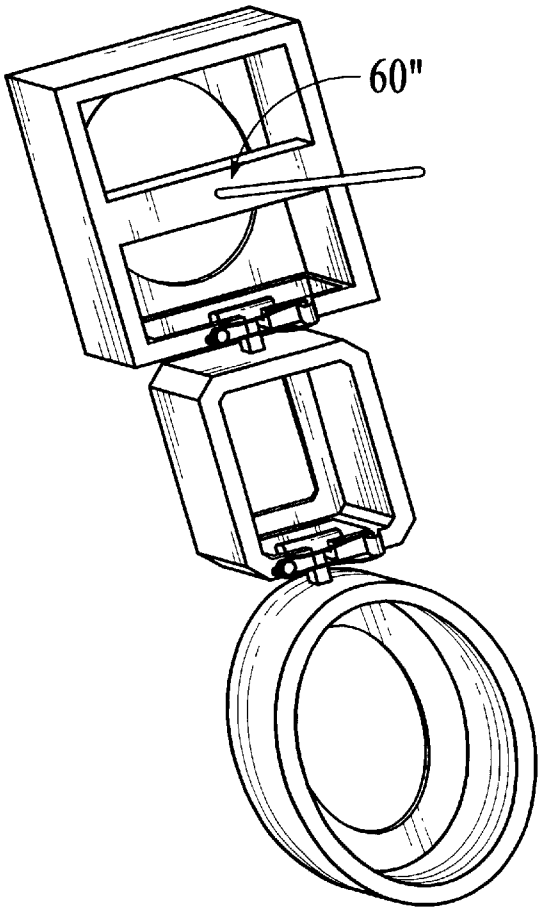

FIGS. 3A, 3B, and 3C show an earring embodiment of Interchangeable Jewelry including a back view—note that the interchangeable mechanisms are substantially visually concealed when the segments are connected to one another (i.e. the absence of obtrusive clasping mechanisms).

Figure 4:
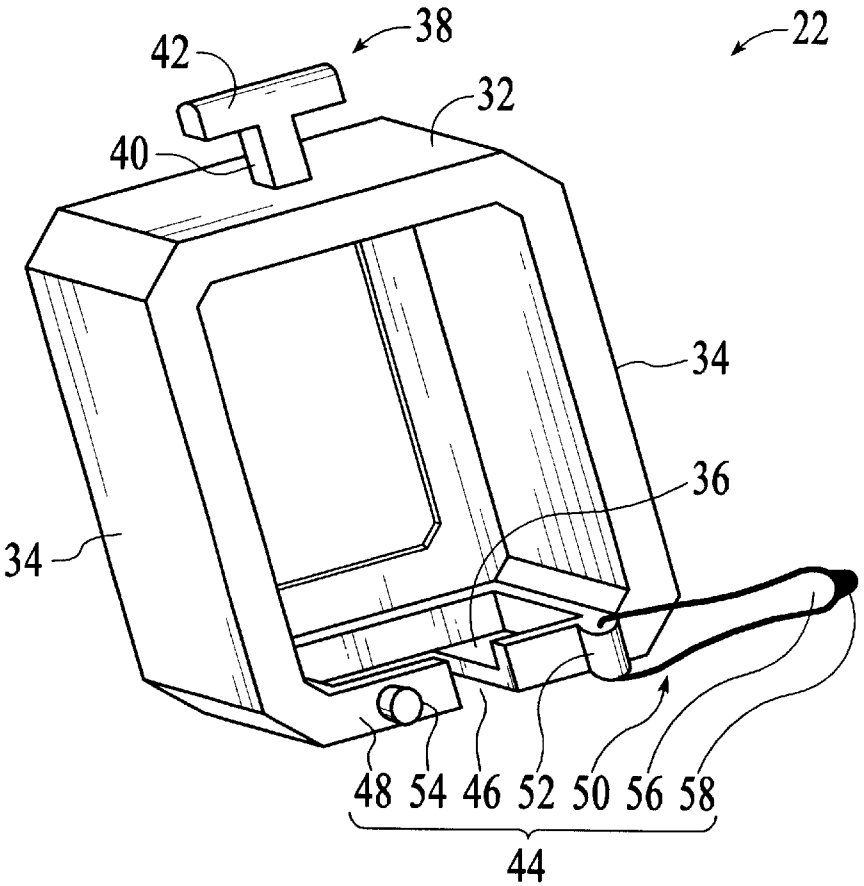

FIG. 4 shows a perspective view of an interchangeable jewelry segment. This particular segment has both male and female connectors for interconnection to adjacent segments both above and below.

FIGS. 5A, 5B, 5C, and 5D show two segments, Segment X and Segment Y, in the main sequential positions that interchangeable jewelry segments go through to become interconnected.

DRAWINGS—REFERENCE NUMERALS

20, 20', 20"—Custom Jewelry Assemblies
22—Interchangeable Jewelry Segment
24—Interchangeable Jewelry Base
26—Gemstone
28—Gemstone mounting
30—Design Element
32—Roof of Interchangeable Jewelry Segment
34—Wall of Interchangeable Jewelry Segment
36—Floor of Interchangeable Jewelry Segment
38—Male Interchangeable Mechanism
40—Post
42—Obstacle
44—Female Interchangeable Mechanism
46—Slot
48—Floor Barrier Wall
50—Latch Assembly
52—Hinge Point
54—Button
56—Button Hole
58—Finger Tab
60, 60', 60"—Body Attachment Mechanisms

DETAILED DESCRIPTION—FIGS. 1 THROUGH 5D—PREFERRED EMBODIMENT

Figure 1A:
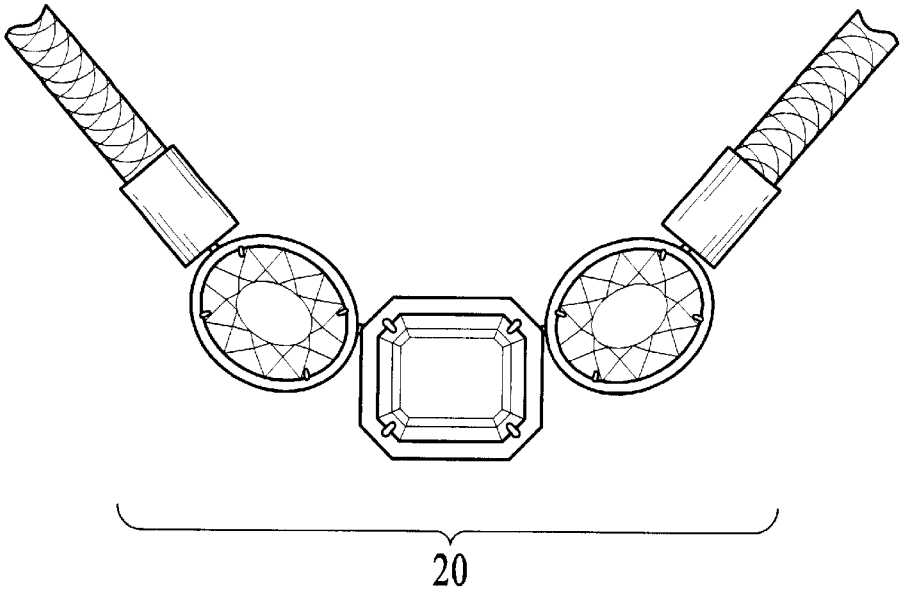
FIGS. 1A and 1B show a necklace embodiment of Interchangeable Jewelry.
Figure 1B:
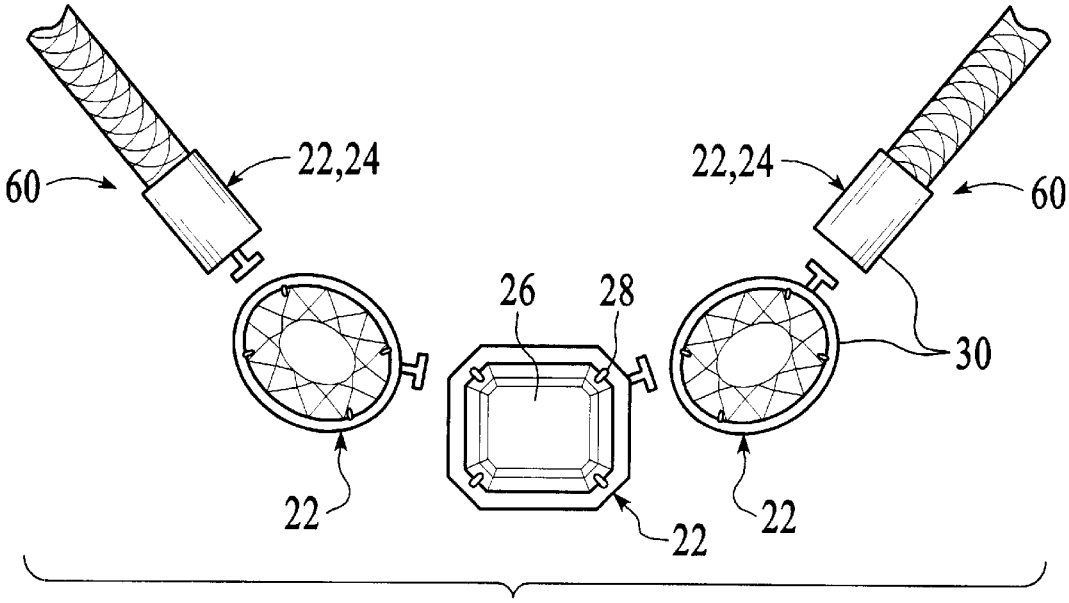
Figure 2A:
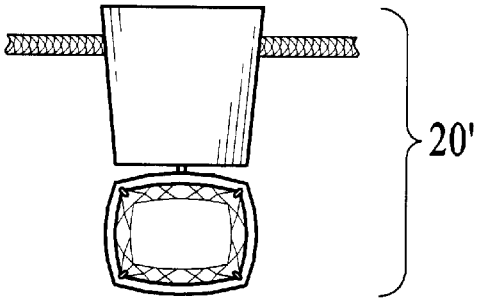
FIGS. 2A and 2B show a pendant embodiment of Interchangeable Jewelry.
Figure 2B:
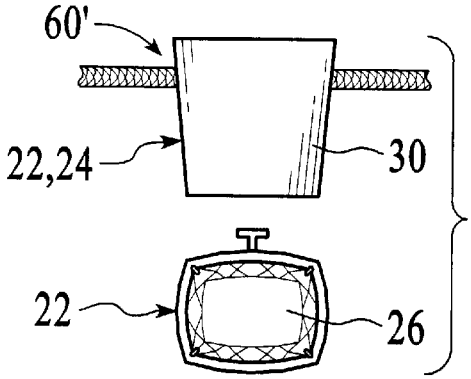

Throughout this description successive figures will focus more and more on certain aspects of Interchangeable Jewelry. FIG. 1, FIG. 2, and FIG. 3 show different styles of Interchangeable Jewelry, specifically a necklace, a pendant, and an earring respectively. In FIG. 1, for example, one notes that, as shown, the necklace consists of five interchangeable jewelry segments 22. It should not be implied from this that the preferred embodiment consists of either a necklace, a necklace with five (or any specific number of) segments, or of segments with or without gemstones and/or aesthetic designs. Rather the preferred embodiment refers to the structure of the male and female interchangeable mechanisms, 38 and 44 respectively, and the main body of the segment, which together allow for interchangeability.

FIGS. 3A and 3B show the front view of an earring custom jewelry assembly 20". FIG. 3A shows the assembly fully connected while FIG. 3B shows the assembly as individual interchangeable jewelry segments. Assembly 20" in FIGS. 3A, 3B, and 3C consists of three interchangeable jewelry segments 22, but it should be generally understood that any number of interchangeable jewelry segments can be used. In order to attach the earring to the body, the top interchangeable jewelry segment 22 is an interchangeable jewelry base 24.

FIG. 3C shows a rear perspective view of the same custom jewelry assembly 20" that is shown in FIGS. 3A and 3B. From the back, the male and female interchangeable mechanisms, 38 and 44 respectively, now come into view. In order to clearly distinguish between mechanisms 38 and 44, refer to FIG. 4 and the description below.

FIG. 4 shows the middle interchangeable jewelry segment 22 from custom jewelry assembly 20" in a rear perspective view. In this example figure, the interchangeable jewelry segment 22 possesses one each of the optional male 38 and female 44 interchangeable mechanisms, both of which are structurally associated with the main body of the segment. Not present in FIG. 4 are attachments for connecting to the body which are also structurally associated with the main body of the segment—these mechanisms can be seen on interchangeably jewelry base segments 24 in FIGS. 1–3. The interchangeable jewelry segment 22 of FIG. 4 generally consists of a center section in which a gemstone 26 (not shown in this figure), is mounted in a gemstone mounting 28 (not shown in this figure). More generally, gemstones and design elements 30 (not shown in FIG. 4) are optional components of an interchangeable jewelry segment 22. As can be seen throughout the figures, the aesthetic design component 30 can be present in or on any part(s) of an interchangeable jewelry segment and can be of any manifestation. For example, the design component might consist of an engraving, a metal finish, gemstones, or some form of non-interchangeable assembly structurally associated with the main body. The gemstone 26 itself, as well as other gemstones can be considered part of the aesthetic design component of the segment, and thus structurally associated with the main body of the segment. Indeed, since the main body can generally consist of anything with mass, it is within the spirit of this patent that a segment's main body may consist of little else other than a gemstone.

As shown in FIG. 4, from the front of the interchangeable jewelry segment 22, protruding toward the back of segment 22 are a roof 32, walls 34, and a floor 36. While items 32, 34, and 36 provide an enclosure for the piece, they also provide a platform from which the interchangeable mechanism elements can be added.

In FIG. 4, a post 40 is attached to the roof 32 so as to protrude above the surface of the roof 32. Attached to the post is an obstacle 42. The obstacle 42 in FIG. 4 is shaped like a bar or rod, and attached in a perpendicular fashion to the post 40, such that the combination of the post 40 and the obstacle 42 form the shape of the letter "T". The combination of the post 40 and the obstacle 42 mounted on the roof 32 form the male interchangeable mechanism 38 of the interchangeable jewelry segment 22.

In FIG. 4, the back end of the floor 36, has from it projecting a short distance toward the roof 32, a barrier wall 48. The barrier wall 48 is attached to the floor 36 in such a fashion that there is space behind the barrier wall 48 in which an item can rest without falling out; the barrier wall 48 is sufficiently short to as not obstruct the open nature of the back of an optional gemstone. Cut into both the floor 36 and the barrier wall 48 is a slot 46. The slot 46 should be present in such a fashion that there is a continuous lack of material through the barrier wall 48 and into the slot 46, but not reaching to the front of the interchangeable jewelry segment 22, unless part of the design element 30. The floor 36 can have an indentation (not shown) in it in the general shape of the obstacle 42 so that the obstacle 42 generally comes to rest in a desired position.

As shown in FIG. 4, attached to the outside of the barrier wall 48 is a latch assembly 50. The latch assembly 50 is attached to the barrier wall 48 on one side of the slot 46 by insertion into a hollow cylinder, which is itself attached to the barrier wall 48 and the floor 36. The latch assembly 50 passes through this cylinder, known as a hinge point 52, from above and below. The latch assembly 50 is of such a shape as to resemble somewhat an open figure-8 or hourglass. The section of the figure-8 of latch assembly 50 farthest from the hinge point 52 consists of an opening known as a button hole 56. This button hole 56 will contain a button 54 when the latch assembly 50 is in the closed position. From the end farthest from the hinge point 52, material in the form of a finger tab 58 has been added to the latch assembly 50 to facilitate manual operation of the latch assembly 50 into and out of the closed position. Note that the finger tab 58 is angled slightly outward (angle not shown) from the plane of the latch assembly 50; this is so that when latch assembly 50 is in the closed position, one can fit one's fingernail or some other item underneath the finger tab 58 to lift the latch assembly 50 out of the closed position. On the opposite side of the barrier wall 48 from the hinge point 52 as viewed in relation to the slot 46, is attached the button 54. The button 54 is attached to the outer side of the barrier wall 48, located so that when the latch assembly 50 is closed, the button 54 rests inside the button hole 56.

The combination of the floor 36, slot 46, barrier wall 48, latch assembly 50, hinge point 52, button 54, button hole 56, and the finger tab 58 form the female interchangeable mechanism 44 of the interchangeable jewelry segment 22.

It should be generally understood throughout this patent and the above description that all items are attached to relevant adjacent items by some means commensurate with the materials of which they are made (e.g. metalworking if items are made from metal).

It should be noted that body attachment mechanisms 60, 60', and 60" are not explicitly described in that they are generally understood to be of a nature that is within the public domain. The extent to which they are a part of this patent is limited to their presence on said interchangeable jewelry bases 24.

It should be noted that the male and female interchangeable mechanisms as set forth in the claims are meant to include the preferred embodiment as well as any other similar mating mechanisms which provide substantial visual concealment. This can include an interference fit, ball and socket, snap, button, clamp, magnet, pin and groove+ keyhole, rotating paddle, flip-lock clasp, hook, and hook and loop mechanisms.

OPERATION OF INVENTION—PREFERRED EMBODIMENT

Since, in most cases, the jewelry will either be attached or connected to the human body directly in some fashion (e.g. a metal rod passed through the earlobe for an earring as in FIG. 3C item 60"), or indirectly via a mechanism that further attaches to the human body (e.g. a connector to a necklace chain as in FIG. 1B item 60), it is assumed that one of the interchangeable jewelry segments in a custom jewelry assembly will be an interchangeable jewelry base. It is further assumed that the user will decide on the total number of interchangeable jewelry segments to be used in the custom jewelry assembly. Accordingly, the operational description of Interchangeable Jewelry System will focus of the operation of the preferred embodiment of the interchangeable mechanism by considering two interchangeable jewelry segments. The first segment, Segment X, will be assumed to possess at least one female interchangeable mechanism 44. The second segment, Segment Y, will be assumed to possess at least one male interchangeable mechanism 38 as shown in FIG. 5A.

Figure 5A:
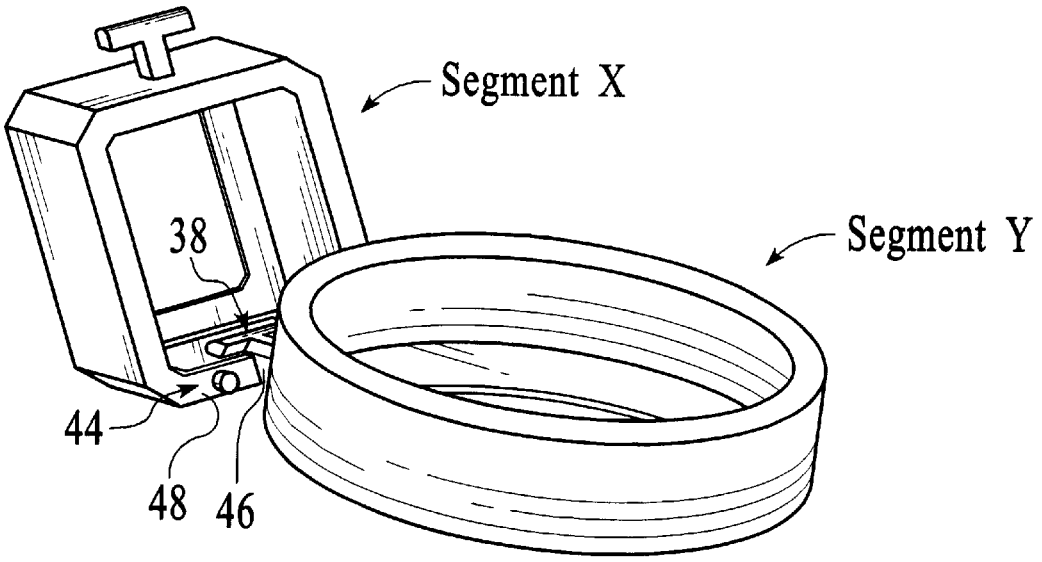
Figure 5B:
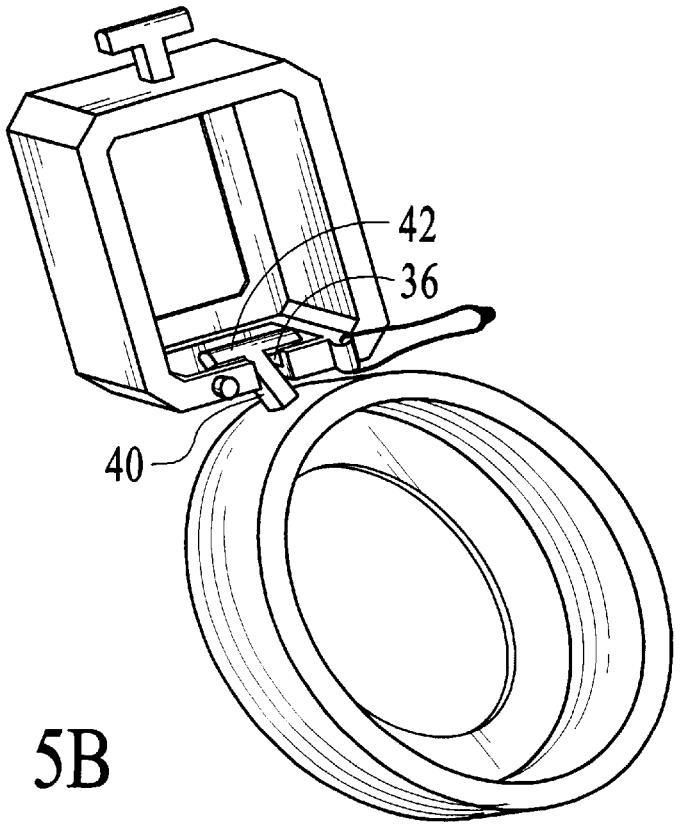
Figure 5D:
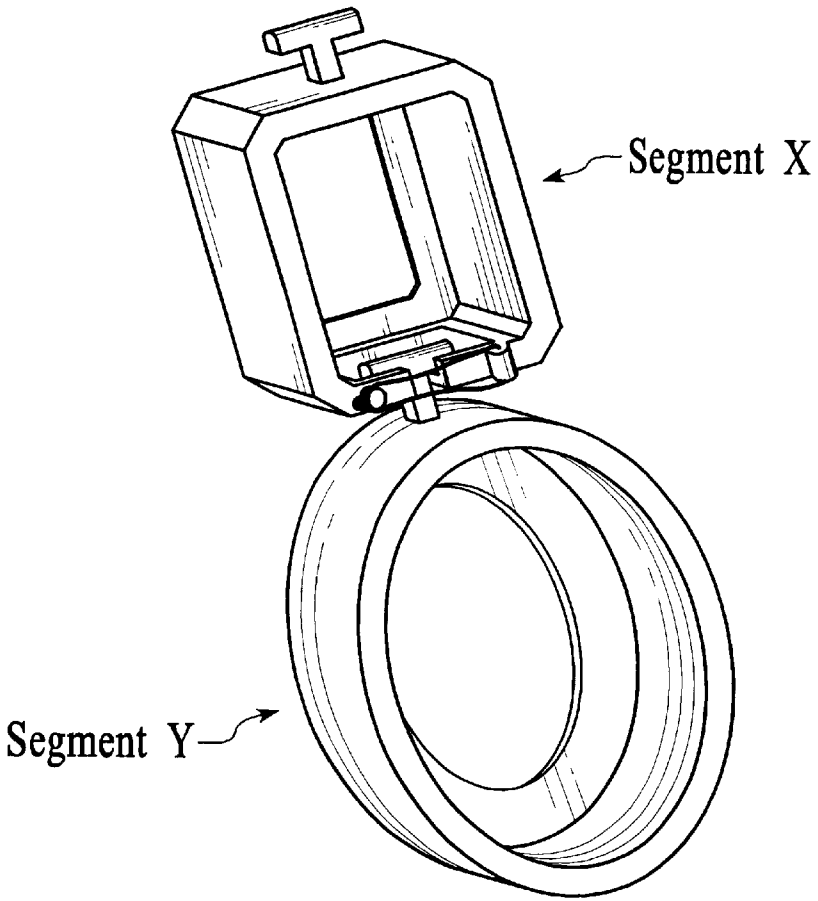
Figure 5C:
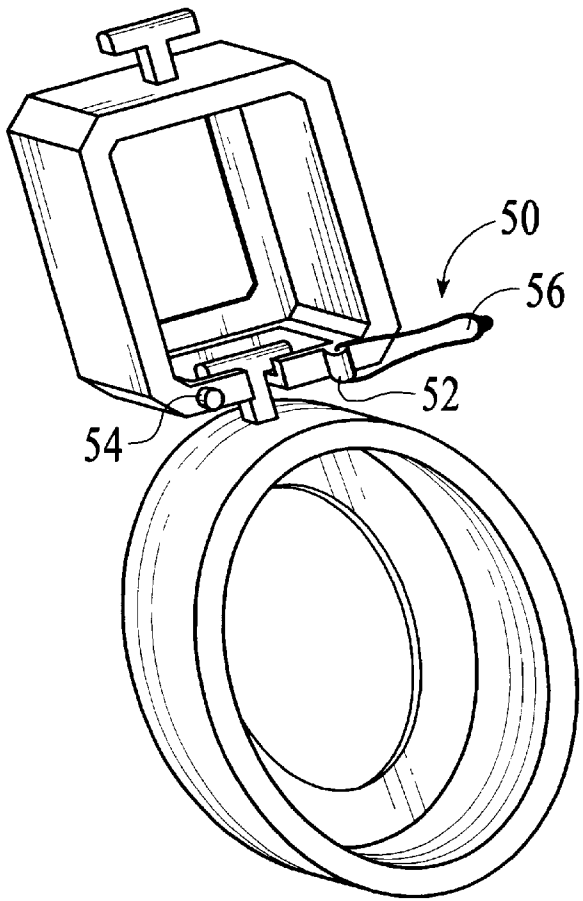

Operation of the preferred embodiment of the interchangeable mechanism is very simple and is shown in FIGS. 5A, 5B, 5C, and 5D. The latch assembly 50 of Segment X should be opened, if not already open, by lifting up on the finger tab 58. As the finger tab 58 is lifted, the latch assembly 50 will rotate about the hinge point 52 so that no part of the latch assembly 50 covers the slot 46; this position can be seen in FIG. 4. Segment Y should now be positioned such that the post 40 is pointing directly into the back of Segment X and the front of Segment Y is facing "down" with respect the front of Segment X, as shown in FIG. 5A. In the position shown in FIG. 5A, Segment Y is placed into Segment X such that the post 40 of Segment Y is directly above the slot 46, and the obstacle 42 is behind the barrier wall 48, and above the slot 46 and the floor 36. Segment Y is within Segment X such that the obstacle 42 comes to rest on the floor 36. As shown in the sequence of FIGS. 5B and 5C, the entirety of Segment Y can now be rotated about the intersection of the post 40 and the obstacle 42 on the floor 36 of Segment X such that both segments now face the same direction, and Segment Y is hanging directly below Segment X. Segment Y now hangs from Segment X because the post 40 of Segment Y protrudes above the floor 36 of Segment X through Segment X's slot 46, and the obstacle 42 is of a shape as to not fall through the slot 46.

The final step in assembling the two pieces is to close the latch assembly 50, as shown in FIG. 5D. The latch assembly 50, which was previously opened, is now pushed in the other direction such that it rotates about the hinge point 52 back toward the direction of the slot 46 and the button 54. When the latch assembly 50 comes to rest on the button 54, it should be pushed further, such that the button 54 snaps into the button hole 56 on the latch assembly 50. The secured latch assembly 50 now prevents the post 40 from rotating out of the slot 46 in the barrier wall 48, thus securing Segment X and Segment Y together.

This simple process need only be repeated for as many interchangeable jewelry segments as the user wishes to use in his or her custom jewelry assembly—the user can daisy chain interchangeable jewelry segments as long as they desire.

CONCLUSION, RAMIFICATIONS, AND SCOPE OF INVENTION

Thus, the reader will see that the Interchangeable Jewelry System described herein provides a highly flexible, unobtrusive, easy-to-use, and affordable system of jewelry, which fills a marketplace need for dynamic jewelry that the wearer can personalize.

While the above description contains many specificities, these should not be construed as limitations on the scope of the invention, but rather as an exemplification of one preferred embodiment thereof. For example:

(1) the interchangeable jewelry segments may or may not contain gemstones; if not, they may consist entirely of different materials (gold, silver, etc.) decorated in some fashion;

(2) the interchangeable jewelry bases may or may not contain gemstones;

(3) gemstones which optionally reside in interchangeable jewelry segments may be set or held in place in some other fashion (bezel-set, etc.);

(4) a bracelet or brooch of Interchangeable Jewelry may be created using the same Interchangeable Jewelry System described;

(5) The mechanism holding one interchangeable jewelry segment to the one above it may not have a T-bar shaped mechanism. Rather it could have any sort of obstacle to keep the two segments interlocked. This obstacle could be designed in such a way as to provide a desired amount of rotational freedom of movement. For example, a spherical obstacle would allow for 360 degree rotation of a given interchangeable jewelry segment about the one above it;

(6) The mechanism holding one interchangeable jewelry segment to the one above it may have any number of male and female interchangeable mechanisms (two, three, etc.);

(7) The interchangeable jewelry segments may have the functional elements of interconnection (male and female interchangeable mechanisms) mounted at any angle and/or at any position on the segment. This could be used, for example, to create segments that hang at different orientations with respect to the body or the other elements of the custom jewelry assembly;

(8) The latch assembly does not have to be of the butterfly, or figure-8, type described. Rather it can be any type mechanism to provide extra security and keep the interchangeable jewelry segments interlocked.

Accordingly, the scope of the invention should be determined not by the embodiment(s), but by the appended claims and their legal equivalents.

What is claimed:

1. A system of jewelry, comprised of interchangeable linkable segments with linking mechanisms being substantially visually concealed, each segment of which is comprised of a main body and one or more of the following:

(a) a female interchangeable mechanism structurally associated with said main body for interconnection to segments with a male interchangeable mechanism; said female interchangeable mechanism comprising a floor and a floor barrier wall into which a slot is cut, and a latch assembly providing a secure closure mechanism to retain the male mechanism when it is placed within the female mechanism;

(b) a male interchangeable mechanism structurally associated with said main body for interconnection to segments with a female interchangeable mechanism; said male interchangeable mechanism is comprising a post being substantially perpendicular to the plane of said segment, and an obstacle mounted on the end of the post which impedes unintended retraction of the post when it is placed within the female mechanism;

wherein said post and obstacle of the male mechanism are dimensioned to fit securely within said slot of said female mechanism and said barrier wall is dimensioned to be at least as tall as the thickness of said obstacle, thus creating a recessed volume behind said wall, and said recessed volume is located on said segment in a position so as to substantially visually conceal said obstacle and post; said slot and said wall forming a recessed area within which said male mechanism can be substantially articulated within the female mechanism in which it resides without becoming disengaged; whereby a unique custom jewelry assembly can be dynamically created using one or more interchangeable segments, where said male and female interchangeable mechanisms are substantially visually concealed and securely fastened to one another;

wherein a first linkable segment has at least one male mechanism affixed to and protruding outward from an exterior wall of said first segment and configured for mating engagement with the female mechanism on a second linkable segment, said female mechanism having an open space within said recessed volume, said open space having sufficient dimensions so that the mating linkable segments are readily separable and can be removed without substantial force when said latch assembly is opened.

2. The jewelry system of claim 1 further comprising components structurally associated with said main body which enable connection to the human body or to an item which connects to the human body.

3. The jewelry system of claim 1 further comprising at least one gemstone mounted on said main body.

4. The jewelry system of claim 1 further comprising an aesthetic design applied to at least a portion of the said main body of a segment.

5. The jewelry system of claim 1 wherein said latch assembly comprises a butterfly latch.

6. The jewelry system of claim 1 where a multiplicity of individual jewelry segments are connected sequentially in a chain manner or to form a chain.

7. The jewelry system of claim 1 in which the segments can be assembled interchangeably between earrings, necklaces, pendants, brooches, bracelets, and other jewelry styles.

8. The jewelry system of claim 1 wherein the shape of said male mechanism can vary.

9. The jewelry system of claim 1 wherein the size of said male mechanism can vary.

10. The jewelry system of claim 1 wherein the shape of said female mechanism can vary.

11. The jewelry system of claim 1 wherein the size of said female mechanism can vary.

* * * * *